US012338721B2

(12) United States Patent
Zeng et al.

(10) Patent No.: US 12,338,721 B2
(45) Date of Patent: Jun. 24, 2025

(54) COAL MINING SYSTEM AND METHOD OF DUAL CIRCULATION DRILLING WITH MECHANICAL REAMING AND ABRASIVE JET

(71) Applicant: CHINA UNIVERSITY OF MINING AND TECHNOLOGY, BEIJING, Beijing (CN)

(72) Inventors: Yifan Zeng, Beijing (CN); Donghui Yang, Beijing (CN); Qiang Wu, Beijing (CN); Zilong Yuan, Beijing (CN); Hao Li, Beijing (CN); Junhao Ren, Beijing (CN); Zeyang Liu, Beijing (CN); Jia Zhao, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 18/760,395

(22) Filed: Jul. 1, 2024

(65) Prior Publication Data

US 2025/0172062 A1 May 29, 2025

(30) Foreign Application Priority Data

Nov. 23, 2023 (CN) ..... 202311579008.3

(51) Int. Cl.
*E21B 43/29* (2006.01)
*E21B 7/18* (2006.01)
(Continued)

(52) U.S. Cl.
CPC ..... *E21B 43/29* (2013.01); *E21B 7/18* (2013.01); *E21B 10/32* (2013.01); *E21B 21/14* (2013.01); *E21B 43/35* (2020.05); *E21B 21/12* (2013.01)

(58) Field of Classification Search
CPC ..... E21B 43/006; E21B 21/12; E21B 21/065; E21B 21/067; E21B 10/32; E21B 10/322; E21B 10/325; E21B 43/29; E21B 7/18
(Continued)

(56) References Cited

U.S. PATENT DOCUMENTS 3,175,613 A * 3/1965 Parker ..... E21B 43/114 166/300
4,134,619 A * 1/1979 Bunnelle ..... E21B 21/10 175/215
(Continued)

FOREIGN PATENT DOCUMENTS

CN 102797465 A 11/2012
CN 109667546 A 4/2019
(Continued)

OTHER PUBLICATIONS

First Office Action issued in counterpart Chinese Patent Application No. 202311579008.3, dated May 20, 2024.
(Continued)

*Primary Examiner* — Sunil Singh
(74) *Attorney, Agent, or Firm* — Westbridge IP LLC

(57) ABSTRACT

Disclosed are a coal mining system and a coal mining method. The coal mining system includes: a mechanical coal breaking module, an air lift reverse circulation module, a jet coal breaking module, and a coal-air-water separation module. The mechanical coal breaking module includes: a drill pipe rotating device, a drill pipe, and a reamer bit, sequentially connected to perform rotary cutting, drilling and slotting operations on a coal seam in a borehole. The air lift reverse circulation module includes: an air compressor and a dual-wall drill pipe. The air compressor is configured to transport a coal-air-water mixture through an inner pipeline of the dual-wall drill pipe to the coal-air-water separation module. The jet coal breaking module includes: the drill pipe
(Continued)

rotating device, a fracturing truck, the drill pipe, and a jet tool string, sequentially connected to mine the coal seam.

4 Claims, 5 Drawing Sheets

(51) Int. Cl.
*E21B 10/32* (2006.01)
*E21B 21/14* (2006.01)
*E21B 43/34* (2006.01)
*E21B 21/12* (2006.01)

(58) Field of Classification Search
USPC ..... 299/16, 17
See application file for complete search history.

(56) References Cited

U.S. PATENT DOCUMENTS 4,615,564 A * 10/1986 Garrett ..... E21B 43/35 175/71
2006/0201715 A1* 9/2006 Seams ..... E21B 43/25 175/65
2022/0389802 A1 12/2022 Steele

FOREIGN PATENT DOCUMENTS

CN 210790585 U 6/2020
CN 114483028 A 5/2022

OTHER PUBLICATIONS

Second Office Action issued in counterpart Chinese Patent Application No. 202311579008.3, dated Aug. 1, 2024.
Zeng et al., Research on Drilling Hydraulic Coal Mining Technology, Energy Technology and Management, 2007, vol. 3, pp. 10-12, dated Mar. 31, 2007.
Third Office Action issued in counterpart Chinese Patent Application No. 202311579008.3, dated Oct. 12, 2024.

* cited by examiner

COAL MINING SYSTEM AND METHOD OF DUAL CIRCULATION DRILLING WITH MECHANICAL REAMING AND ABRASIVE JET

CROSS-REFERENCE TO RELATED APPLICATIONS

This application claims priority to Chinese Patent Application No. 202311579008.3, filed on Nov. 23, 2023, the content of which is incorporated herein by reference in its entirety.

TECHNICAL FIELD

The present application relates to coal and gas jointly mining technology, in particular to a coal mining system and a coal mining method of dual circulation drilling with mechanical reaming and abrasive jet.

BACKGROUND

Coal is an important energy source. However, due to complex mining conditions and ever-changing environments of the coal, performing coal mining operations is quite difficult. Meanwhile, traditional coal mining techniques have significant limitations and the safety of coal mining workers cannot be guaranteed when any accident occurs. Moreover, in actual situations, a coal mining process may be affected by coalbed methane, which results in a low mining efficiency.

SUMMARY

In view of the above, examples of the present disclosure provide a coal mining system and a coal mining method of dual circulation drilling with mechanical reaming and abrasive jet.

The coal mining system of dual circulation drilling with mechanical reaming and abrasive jet according to examples of the present disclosure may include: a mechanical coal breaking module, an air lift reverse circulation module, a jet coal breaking module, and a coal-air-water separation module. The mechanical coal breaking module may include: a drill pipe rotating device, a drill pipe, and a reamer bit. The drill pipe rotation device, the drill pipe and the reamer bit may be sequentially connected to perform rotary cutting, drilling and slotting operations on a coal seam in a borehole. The air lift reverse circulation module may include: an air compressor and a dual-wall drill pipe. The air compressor is configured to transport a coal-air-water mixture through an inner pipeline of the dual-wall drill pipe to the coal-air-water separation module. The jet coal breaking module may include: the drill pipe rotating device, a fracturing truck, the drill pipe, and a jet tool string. The fracturing truck, the drill pipe rotation device, the drill pipe, and the jet tool string may be sequentially connected to mine the coal scam.

In some examples of the present disclosure, the mechanical coal breaking module may further include: a drilling fluid truck and a high pressure piping. The drilling fluid truck may be installed on the ground and connected to the borehole through the high pressure piping. The drill pipe rotating device may be set at a wellhead of the borehole.

In some examples of the present disclosure, the air lift reverse circulation module may further include: a single wall drill pipe, an air-liquid mixer, and a roller bit. The air compressor may be set on the ground and connected to the dual-wall drill pipe through the high pressure piping. A bottom end of the dual-wall drill pipe may be equipped with the air-liquid mixer and connected to the single wall drill pipe. The single wall drill pipe may be connected to the roller bit.

In some examples of the present disclosure, the jet coal breaking module may further include: a mixing truck, an abrasive tank, and a water tank. The abrasive tank and the water tank may be respectively connected to the mixing truck. The mixing truck may be connected to the fracturing truck to supply mixed abrasive. The fracturing truck may be connected to the drill pipe through a high-pressure hose to supply high-pressure abrasive.

In some examples of the present disclosure, the coal-air-water separation module may include: a coal-air-water separator and a sedimentation tank. The coal-air-water separator may be connected to the dual-wall drill pipe. The coal-air-water separator may be connected to the sedimentation tank.

In some examples of the present disclosure, a water baffle may be installed inside the sedimentation tank. The bottom of the sedimentation tank may be equipped with a pump to pump the water from the sedimentation tank to the borehole.

Based on a same invention concept, examples of the present disclosure also provide a coal mining method of dual circulation drilling with mechanical reaming and abrasive jet, which can be applied to the coal mining system disclosed above. The coal mining method may include the following steps: performing rotary cutting, drilling and slotting operations on a coal scam in a borehole through a mechanical coal breaking module; transporting a coal-air-water mixture formed after the rotary cutting, drilling and slotting operations to a coal-air-water separation module through an air lift reverse circulation module; performing coal breaking operations on the coal scam through the jet coal breaking module; transporting the coal-air-water mixture formed after the coal breaking operations to the coal-air-water separation module through the air lift reverse circulation module; and separating the coal-air-water mixture to obtain coal, coalbed methane and water through the coal-air-water separation module.

In some examples of the present disclosure, transporting a coal-air-water mixture formed after the rotary cutting, drilling and slotting operations to a coal-air-water separation module through an air lift reverse circulation module may include: delivering high-pressure air to an annular gap between an inner wall and an outer wall of the dual-wall drill pipe through an air compressor in the air lift reverse circulation module; delivering the high-pressure air to the coal-air-water mixture in an inner pipe of the dual-wall drill pipe through the air-liquid mixer in the air lift reverse circulation module; and transporting the coal-air-water mixture to the coal-air-water separation module through an inner pipe of the single wall drill pipe in the air lift reverse circulation module and the dual-wall drill pipe in the air lift reverse circulation module by reverse circulations.

In some examples of the present disclosure, performing coal breaking operations on the coal seam through the jet coal breaking module may include: pressurizing water and sand in a mixing truck in the jet coal breaking module through a fracturing truck in the jet coal breaking module; transporting the water and sand pressurized through a high-pressure hose to a jet tool string in the jet coal breaking module; and performing an abrasive jet rotary cutting on the coal scam through the jet tool string to implement a retractable coal mining.

In some examples of the present disclosure, performing an abrasive jet rotary cutting on the coal seam through the jet tool string may include: making a circular cross-section formed by jet directions of a rotary cutting performed by the jet tool string perpendicular to a roof and a floor of the coal seam; and mining the coal seam with the jet tool string.

From the above description, it can be seen that the coal mining system provided by example of the present disclosure may include: a mechanical coal breaking module, an air lift reverse circulation module, a jet coal breaking module, and a coal-air-water separation module. The mechanical coal breaking module may include: a drill pipe rotating device, a drill pipe, and a reamer bit. The drill pipe rotation device, the drill pipe and the reamer bit are sequentially connected to perform rotary cutting and slotting operations on a coal seam in a borehole. The air lift reverse circulation module may include: an air compressor and a dual-wall drill pipe. The air compressor is configured to transport a coal-air-water mixture through an inner pipe of the dual-wall drill pipe to the coal-air-water separation module. The jet coal breaking module may include: the drill pipe rotating device, a fracturing truck, the drill pipe, and a jet tool string. The fracturing truck, the drill pipe rotation device, the drill pipe, and the jet tool string are sequentially connected to mine the coal seam. The coal mining system proposed in examples of the present disclosure can complete mining of coal seams without human working in boreholes. In this way, risks caused by coal and gas outbursts, rock burst, or water inrush during mining can be effectively reduced. Since only a few people are needed to operate drilling rigs on the ground, the working environment is greatly improved. Accordingly, labor costs are effectively reduced too.

In addition, all ground supporting facilities in examples of the present disclosure are movable, therefore, the coal mining system and the coal mining method disclosed by examples of the present disclosure are very suitable for mining corner coal with uneven distribution or limited coal resources.

Moreover, in the coal breaking process of the coal mining method, a mechanical mining process of small-scale boreholes may be first performed. Then, large-scale coal mining may be performed by abrasive jet. It can be seen that the coal mining method can be well applied to the mining of ultra-thick coal seams, medium hard to hard coal seams. Furthermore, the technical solution can also be well adapted to the three soft coal seams, "three down" pressure coal seams, and coal and gas outburst coal seams.

In addition, because the coal mining method of the present disclosure adopts a water jet technique to break coal, open fires can be effectively avoided, combustions and gas explosions can also be prevented. Moreover, coal may be washed underground by the flushing of the well water efficiently.

In summary, the coal mining system and the coal mining method of the present disclosure is safe, green, and efficient, with good adaptability and low cost.

BRIEF DESCRIPTION OF THE DRAWINGS

In order to describe technical solutions of the present application or related arts more clearly, accompanying drawings required for describing examples or the related art are introduced briefly in the following. Apparently, the accompanying drawings in the following descriptions only illustrate some examples of the present application, and those of ordinary skill in the art may still derive other drawings from these drawings without creative efforts.

DETAILED DESCRIPTION OF THE EMBODIMENTS

Figure 1:
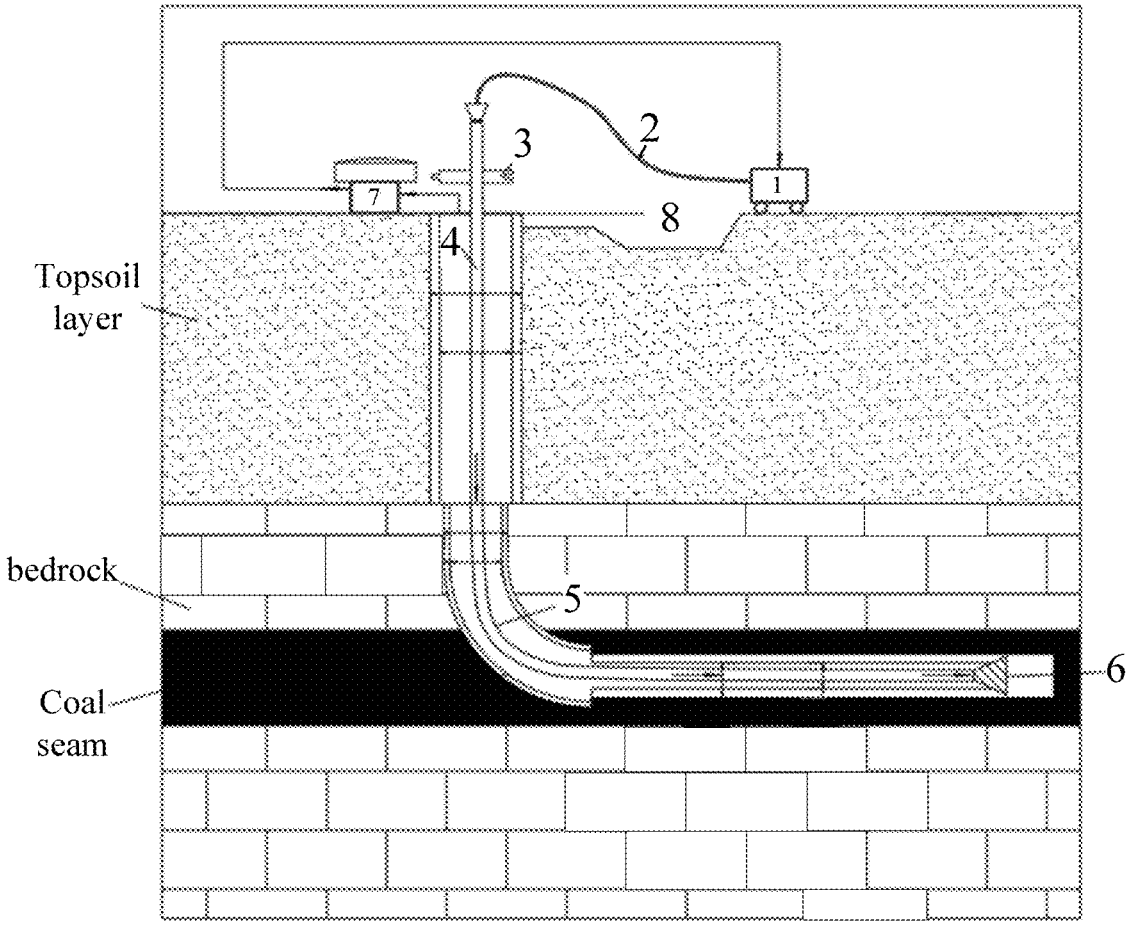
FIG. 1 is a schematic diagram illustrating a structure of the mechanical coal breaking module according to an example of the present disclosure.

Hereinafter, in order to make the objective(s), technical solution(s) and advantages of the present application clearer and more understandable, the present application will be further described in detail, in connection with specific embodiments and with reference to the accompanying drawings.

It is necessary to be noted that the technical terms or scientific terms used in the embodiments of the present application should have common meanings as understood by those skilled in the art of the present application, unless otherwise defined. The "first", "second" and similar words used in the embodiments of the present application do not refer to any sequence, number or importance, but are only used to distinguish different component portions. The "comprise", "include" or a similar word means that an element or item before such word covers an element or item or any equivalent thereof as listed after such word, without excluding other elements or items. The "connect" or "interconnect" or a similar word does not mean being limited to a physical or mechanical connection, but may include a direct or indirect electrical connection. The "upper", "lower", "left" and "right" are used only to indicate a relative position relation, and after the absolute position of the described object is changed, the relative position relation may be changed accordingly.

As disclosed above, traditional coal mining techniques have significant limitations and the safety of coal mining workers cannot be guaranteed when any accident occurs. Moreover, in actual situations, a coal mining process may be affected by coalbed methane, which results in a low mining efficiency.

To solve the above problems, examples of the present disclosure provide a coal mining system of dual circulation drilling with mechanical reaming and abrasive jet, which includes: a mechanical coal breaking module, an air lift reverse circulation module, a jet coal breaking module, and a coal-air-water separation module. The mechanical coal breaking module may include: a drill pipe rotating device, a drill pipe, and a reamer bit. The drill pipe rotation device, the drill pipe and the reamer bit are sequentially connected to perform rotary cutting, drilling and slotting operations on a coal seam in a borehole. The air lift reverse circulation module may include: an air compressor and a dual-wall drill pipe. The air compressor is configured to transport a coal-air-water mixture through an inner pipe of the dual-wall drill pipe to the coal-air-water separation module. The jet coal breaking module may include: the drill pipe rotating device, a fracturing truck, the drill pipe, and a jet tool string. The fracturing truck, the drill pipe rotation device, the drill pipe, and the jet tool string are sequentially connected to mine the coal seam.

The coal mining system proposed in examples of the present disclosure can complete mining of coal seams without human working in boreholes. In this way, risks caused by coal and gas outbursts, rock burst, or water inrush during mining can be effectively reduced. Since only a few people are needed to operate drilling rigs on the ground, the working environment is greatly improved. Accordingly, labor costs are effectively reduced too. In addition, all ground supporting facilities in examples of the present disclosure are movable, therefore, the coal mining system and the coal mining method disclosed by examples of the present disclosure are very suitable for mining corner coal with uneven distribution or limited coal resources. Moreover, in the coal breaking process of the coal mining method, a mechanical mining process of small-scale boreholes may be first performed. Then, large-scale coal mining may be performed by abrasive jet. It can be seen that the coal mining method can be well applied to the mining of ultra-thick coal scams, medium hard to hard coal scams. Furthermore, the technical solution can also be well adapted to the three soft coal seams, "three down" pressure coal seams, and coal and gas outburst coal seams. In addition, because the coal mining method of the present disclosure adopts a water jet technique to break coal, open fires can be effectively avoided, combustions and gas explosions can also be prevented. Moreover, coal may be washed underground by the flushing of the well water efficiently. In summary, the coal mining system and the coal mining method of the present disclosure is safe, green, and efficient, with good adaptability and low cost.

In the following, technical solutions of the coal mining system and the coal mining method will be further explained in detail through specific examples.

Reference signs in the drawings are listed in the following: drilling fluid truck 1, high pressure piping 2, drill pipe rotation device 3, drill pipe 4, directional short section 5, reamer bit 6, coal-air-water separator 7, sedimentation tank 8, air compressor 9, air faucet or air box 10, dual-wall drill pipe 11, air-liquid mixer 12, single wall drill pipe 13, roller bit 14, fracturing truck 15, mixing truck 16, abrasive tank 17, water tank 18, instrument truck 19, drilling fluid tank 20, fracturing tank 21, high-pressure hose 22, jet tool string 23, drill bit pin 24, diamond composite plate 25, main blade 26, blade support rod 27, fixed spring 28, high-pressure water channel 29, central shaft rod 30, support 31, and limit rail 32.

Examples of the present disclosure provide a coal mining system of dual circulation drilling with mechanical reaming and abrasive jet, which includes: a mechanical coal breaking module, an air lift reverse circulation module, a jet coal breaking module, and a coal-air-water separation module. The above different modules work in a pre-built coal mining borehole at different time periods. Corresponding explanations for each module will be given in detail in the following.

FIG. 1 is a schematic diagram illustrating a structure of the mechanical coal breaking module according to an example of the present disclosure.

The mechanical coal breaking module may include: a drill pipe rotating device 3, a drill pipe 4, and a reamer bit 6. The drill pipe rotation device 3, the drill pipe 4, and the reamer bit 6 are sequentially connected. After the connections are completed, the reamer bit 6 placed underground may be opened to perform rotary cutting, drilling and slotting operations on the coal seam in the borehole. The drill pipe 4 may be slowly lifted by the drill pipe rotation device 3 at the wellhead, causing the reamer bit 6 to rotate and retract to perform rotary cutting, drilling and slotting operations.

In some examples, the mechanical coal breaking module may further include: a drilling fluid truck 1 and a high pressure piping 2. The drilling fluid truck 1 may be installed on the ground and connected to the borehole through the high pressure piping 2. The drill pipe rotation device 3 may be set at the wellhead of the borehole.

Specifically, as shown in FIG. 1, in examples of the present disclosure, the mechanical coal breaking module may include: a drilling fluid truck 1, a high pressure piping 2, a drill pipe rotation device 3, a drill pipe 4, a directional short section 5, and a reamer bit 6. The mechanical coal breaking module is mainly configured to perform rotary cutting, drilling and slotting operations on a coal seam in a borehole.

In this example, a ground coal mining borehole (a borehole) may be drilled with an angle to an interface between a coal seam roof and a rock layer. A fiberglass casing may be further arranged parallel to the borehole. The drilling fluid truck 1 can be installed on the ground and connected to the borehole through the high pressure piping 2. The drill pipe rotation device 3 may be set at a wellhead position of the borehole. The drill pipe rotation device 3 may be connected to the drill pipe 4, which runs through the entire borehole. The directional short section 5 may be set at an inclination section of the borehole. The reamer bit 6 may be installed at the bottom of the drill pipe 4.

Figure 2:
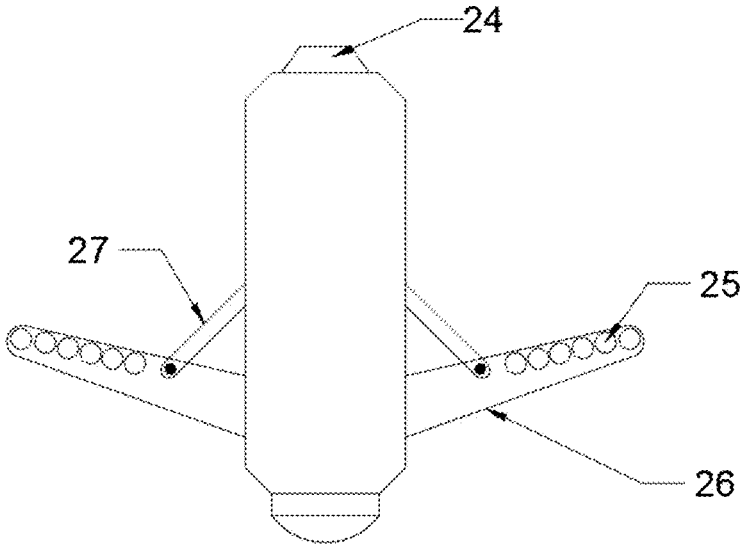
FIG. 2 is a schematic diagram illustrating a structure of the reamer bit according to an example of the present disclosure.

FIG. 2 is a schematic diagram illustrating a structure of the reamer bit according to an example of the present disclosure.

Figure 3:
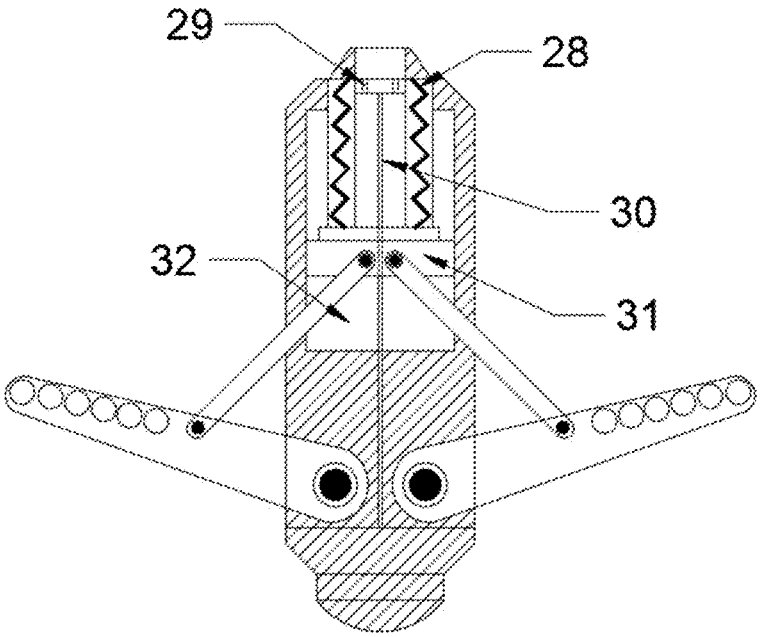
FIG. 3 is a schematic diagram of a longitudinal profile of the reamer bit according to an example of the present disclosure.

FIG. 3 is a schematic diagram of a longitudinal profile of the reamer bit according to an example of the present disclosure.

As shown in FIG. 2 and FIG. 3, the reamer bit 6 may be connected to the drill pipe 4 through a drill bit pin 24. During an installation process, the main blade 26 can be set in a closed state. The main blade 26 may be connected to the support 31 through the blade support rod 27. The central shaft rod 30 may be located at the center of the support 31. The high-pressure water channel 29 may be connected to the central shaft rod 30. The fixed spring 28 and the limit rail 32 are used to restrict movements of the support 31.

Figure 4:
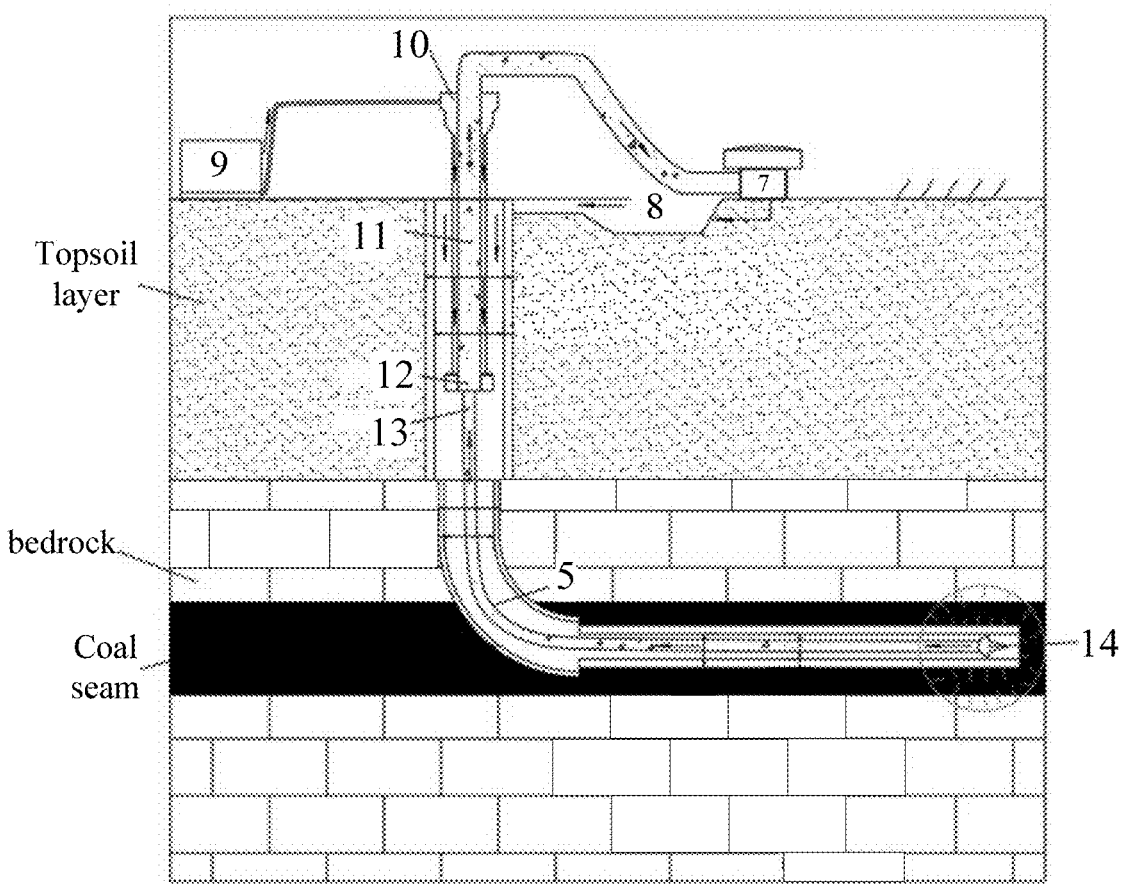
FIG. 4 is a schematic diagram illustrating a structure of the air lift reverse circulation module according to an example of the present disclosure.

FIG. 4 is a schematic diagram illustrating a structure of the air lift reverse circulation module according to an example of the present disclosure.

The air lift reverse circulation module may include: an air compressor 9 and a dual-wall drill pipe 11. The air lift reverse circulation module may be configured to transport a coal-air-water mixture through an inner pipe of the dual-wall drill pipe 11 to the coal-air-water separation module with the air compressor 9. The air compressor 9 may be installed on the ground and connected to the dual-wall drill pipe 11 through a high pressure piping 2.

In some examples of the present disclosure, the air lift reverse circulation module may further include: a single wall drill pipe 13, an air-liquid mixer 12, and a roller bit 14. The air-liquid mixer 12 may be set at a bottom end of the dual-wall drill pipe 11 and connected to the single wall drill pipe 13. The single wall drill pipe 13 may be connected to the roller bit 14.

Specifically, as shown in FIG. 4, the air lift reverse circulation module may include: an air compressor 9, an air faucet or an air box 10, a dual-wall drill pipe 11, an air-liquid mixer 12, a single wall drill pipe 13, and a roller bit 14. In some examples of the present disclosure, the roller bit 14 may be a reverse circulation roller bit.

Specifically, the air compressor 9 may be installed on the ground and connected to the air faucet or the air box 10 through the high pressure piping 2. The air faucet or the air box 10 may be set at a top end of the dual-wall drill pipe 11. The dual-wall drill pipe 11 may be set at a vertical section of the borehole. The air-liquid mixer 12 may be set at a bottom end of the vertical section. The dual-wall drill pipe 11 may be connected to the single wall drill pipe 13 in the vertical section. Moreover, the single wall drill pipe 13 runs through an inclined section and a horizontal section of the borehole, with its end connected to the roller bit 14.

The coal-air-water separation module is also shown in FIG. 4.

In some examples of the present disclosure, the coal-air-water separation module may include: a coal-air-water separator 7 and a sedimentation tank 8. The coal-air-water separator 7 may be connected to the dual-wall drill pipe 11. Moreover, the coal-air-water separator 7 may be connected to the sedimentation tank 8.

In some examples of the present disclosure, a water baffle may be provided inside the sedimentation tank 8. The bottom of the sedimentation tank 8 may be equipped with a pump to pump the water from the sedimentation tank 8 to the borehole, which can supply water between the borehole and the air lift reverse circulation module to maintain a water circulation.

As shown in FIG. 4, the coal-air-water separator 7 may be connected to the dual-wall drill pipe 11. The coal-air-water separator 7 may also be connected to sedimentation tank 8. The coal-air-water mixture transported by the dual-wall drill pipe 11 may enter the coal-air-water separator 7, by which coalbed methane, coal and water may be separated and purified from the coal-air-water mixture. A coal-water mixture generated after an initial coal-air-water separation may enter the sedimentation tank 8. The sedimentation tank 8 may be connected to a pipeline for transporting coal slurry. Moreover, a water inlet baffle may be installed in the sedimentation tank 8 to accelerate a speed of a coal-water separation. The bottom of the sedimentation tank 8 may be set as a trapezoidal area for settling extracted coal particles. A pump may be installed at the bottom of the sedimentation tank 8 to drain water to the borehole through a pipeline. In this way, a circulation of water between the borehole and the air lift reverse circulation module can be achieved.

Figure 5:
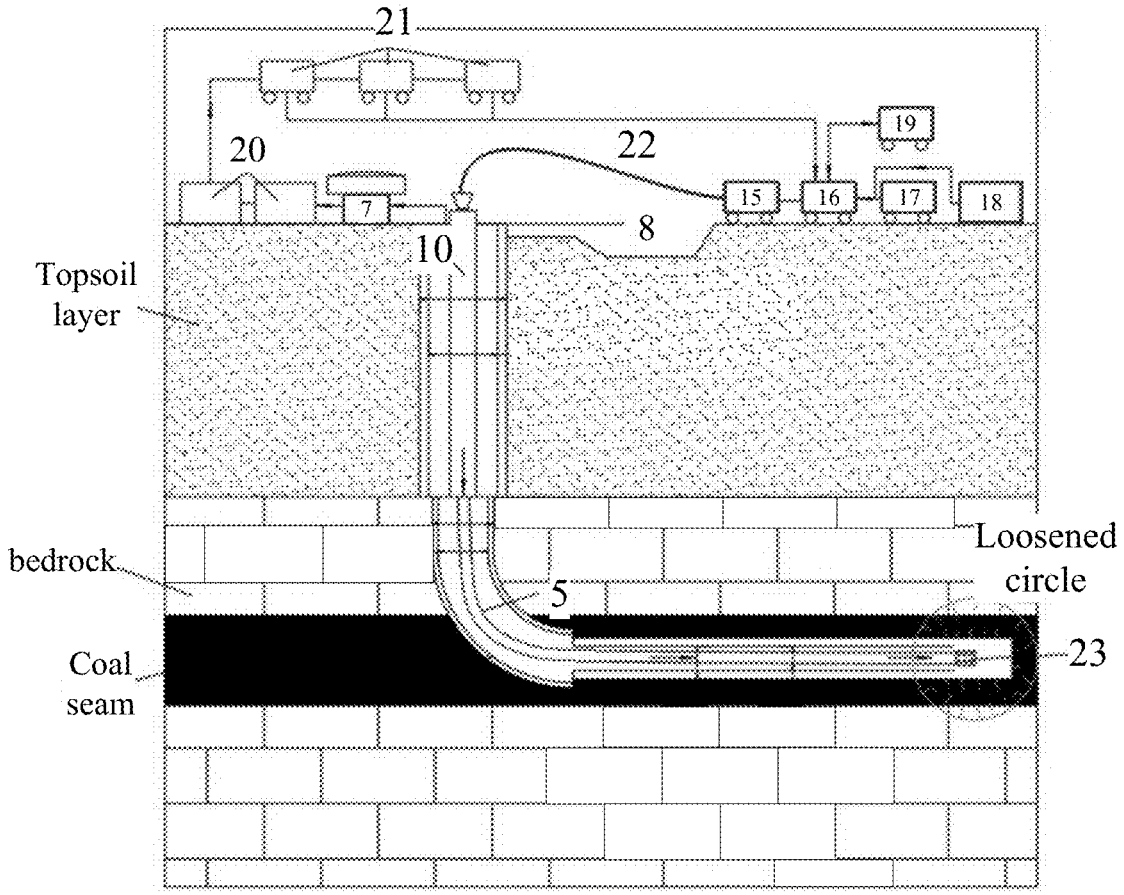
FIG. 5 is a schematic diagram illustrating a structure of the jet coal breaking module according to an example of the present disclosure.

FIG. 5 is a schematic diagram illustrating a structure of the jet coal breaking module according to an example of the present disclosure.

The jet coal breaking module may include: the drill pipe rotating device 3, a fracturing truck 15, the drill pipe 4, and a jet tool string 23. The fracturing truck 15, the drill pipe rotation device 3, the drill pipe 4, and the jet tool string 23 may be sequentially connected to mine the coal scam.

In some examples of the present disclosure, the jet coal breaking module may further include: a mixing truck 16, an abrasive tank 17, and a water tank 18. The abrasive tank 17 and the water tank 18 may be respectively connected to the mixing truck 16. The mixing truck 16 may be connected to the fracturing truck 15 to supply mixed abrasive. The fracturing truck 15 may be connected to the drill pipe 4 through a high-pressure hose 22 to supply high-pressure abrasive.

Specifically, as shown in FIG. 5, the jet coal breaking module may include: a fracturing truck 15, a mixing truck 16, an abrasive tank 17, a water tank 18, an instrument truck 19, a drilling fluid tank 20, a fracturing tank 21, a high-pressure hose 22, and a jet tool string 23.

The fracturing truck 15, the mixing truck 16, the abrasive tank 17, the water tank 18, the instrument truck 19, the drilling fluid tank 20, and the fracturing tank 21 may be set on the ground. One end of the drilling fluid tank 20 may be connected to the coal-air-water separator 7, and the other end of the drilling fluid tank 20 may be connected to the fracturing tank 21. The abrasive tank 17 and the water tank 18 may be respectively connected to the mixing truck 16. The instrument truck 19 may be connected to the mixing truck 16 to observe and control the pressure in real time. The mixing truck 16 may be connected to the fracturing truck 15. The fracturing truck 15 may be connected to the drill pipe 4 at the wellhead through the high-pressure hose 22. The jet tool string 23 may be set at the end of drill pipe 4.

The coal mining system proposed in examples of the present disclosure can complete mining of coal scams without human working in boreholes. In this way, risks caused by coal and gas outbursts, rock burst, or water inrush during mining can be effectively reduced. Since only a few people are needed to operate drilling rigs on the ground, the working environment is greatly improved. Accordingly, labor costs are effectively reduced too. In addition, all ground supporting facilities in examples of the present disclosure are movable, therefore, the coal mining system and the coal mining method disclosed by examples of the present disclosure are very suitable for mining corner coal with uneven distribution or limited coal resources. Moreover, in the coal breaking process of the coal mining method, a mechanical mining process of small-scale boreholes is first performed. Then, large-scale coal mining may be performed by abrasive jet. It can be seen that the coal mining method can be well applied to the mining of ultra-thick coal seams, medium hard to hard coal seams. Furthermore, the technical solution can also be well adapted to the three soft coal seams, "three down" pressure coal seams, and coal and gas outburst coal scams. In addition, because the coal mining method of the present disclosure adopts a water jet technique to break coal, open fires can be effectively avoided, combustions and gas explosions can also be prevented. Moreover, coal may be washed underground by the flushing of the well water efficiently. In summary, the coal mining system and the coal mining method of the present disclosure is safe, green, and efficient, with good adaptability and low cost.

Based on a same concept, the present disclosure also provides a coal mining method applied to the coal mining system corresponding to any of the aforementioned examples.

Figure 6:
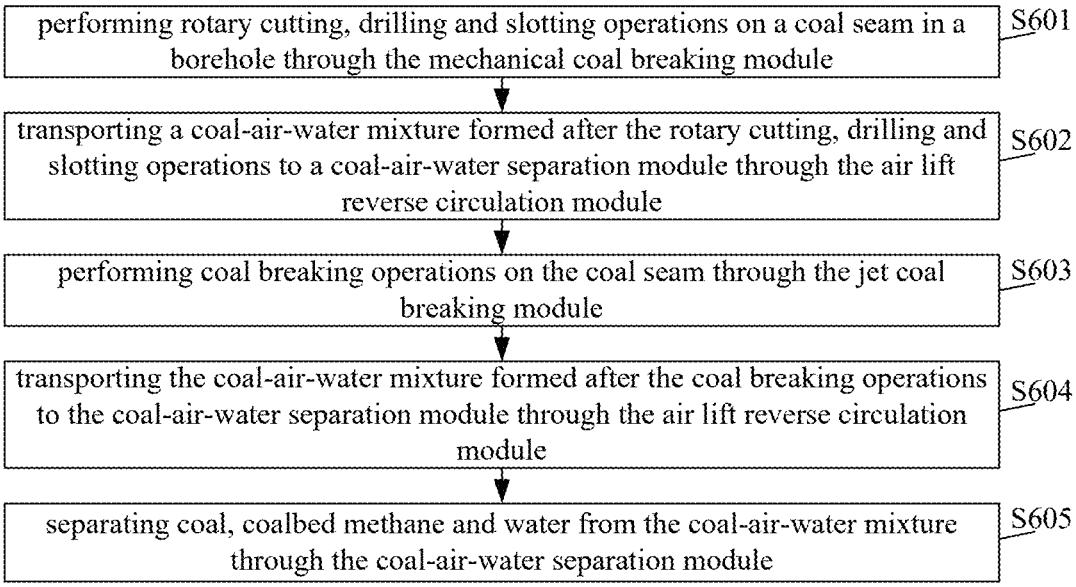
FIG. 6 is a schematic flowchart of the coal mining method according to an example of the present disclosure.

FIG. 6 is a schematic flowchart of the coal mining method according to an example of the present disclosure. As shown in FIG. 6, the coal mining method may include the following steps.

In S601, performing rotary cutting, drilling and slotting operations on a coal seam in a borehole through the mechanical coal breaking module.

In S602, transporting a coal-air-water mixture formed after the rotary cutting, drilling and slotting operations to the coal-air-water separation module through the air lift reverse circulation module.

In S603, performing coal breaking operations on the coal seam through the jet coal breaking module.

In S604, transporting the coal-air-water mixture formed after the coal breaking operations to the coal-air-water separation module through the air lift reverse circulation module.

In S605, separating coal, coalbed methane and water from the coal-air-water mixture through the coal-air-water separation module.

To be noted, a preparation needs to be made before step S601. The preparation may include constructing a coal mining borehole and deploying various devices.

Specifically, to construct the borehole and to deploy the devices, a depth, thickness, distribution range, and lithology of a top rock layer and a bottom rock layer of the coal seam to be mined should be determined through a ground penetrating radar detection method in combination with data from other constructed boreholes at first. Based on these parameters, a length of a mining face, a mining range, and coal entry points should be further determined. Thus, a coal mining borehole can be constructed. Moreover, a sedimentation tank 8 can be constructed near the mining borehole.

Other deployments of the devices may include: deploying the drilling fluid truck 1, the coal-air-water separator 7, the air compressor 9, the fracturing truck 15, the mixing truck 16, the abrasive tank 17, the water tank 18, the instrument truck 19, the drilling fluid tank 20, and the fracturing tank 21 near the coal mining borehole.

Then an L-shaped borehole may be constructed. The construction of the L-shaped borehole may include three processes: a first opening, a second opening and a third opening. In the first opening, a drill bit with Φ 311 mm may be used to drill into the bedrock to form a vertical section. Then a steel pipe with Φ 245 mm may be put into the vertical section and cement may be used for well cementing. In the second opening, a drill bit with Φ 215.9 mm may be used to drill into a top floor of the coal seam to form an inclined section. Then a steel pipe with Φ 177.8 mm may be put into the inclined section and cement may be used for well cementing. In the third opening, a drill bit with Φ 152 mm may be used to drill to a terminal position on a bottom floor of the coal seem to form a horizontal section. Then a steel pipe with Φ 89 mm may be put into the horizontal section and cement may be used for well cementing. It can be seen, by these three processes, an L-shaped borehole may be constructed.

After determining a length of the drill pipe 4 based on a burial depth of the coal seam, the drill pipe 4 with the reamer bit 6 may be inserted into the borehole. The reamer bit 6 may be positioned at a designated position on the working face. Then, the drill pipe 4 may be connected with the drill pipe rotation device 3. Moreover, pipelines may be further connected.

Then in step S601, the reamer bit 6 may be installed onto the drill pipe 4 through the drill bit pin 24. Moreover, the main blade 26 of the reamer bit 6 should be ensured in a closed state. Further, the reamer bit 6 would be driven to a target position of the coal seam position by a motor in the borehole. To be noted, the target place may be a lower limit position of the borehole which needs to be expanded. Turn on a drilling rig outside the borehole to drive the drill pipe 4 to rotate at low speed. At the same time, the pump volume would be increased gradually. High pressure water may flow through the high-pressure water channel 29 into the cavity, pushing the support 31 to move downwards along the central shaft rod 30. The support 31 may push the blade support rod 27 to move synchronously downwards, so that the force of the high-pressure water flow may open the main blade 26 slowly with the drill pipe 4. Further, as the drilling volume continues to increase, the blade 26 may be fully opened, which forms a cross shape with the reamer bit 6. While drilling, the reamer bit 6 may rotate synchronously with the drill pipe 4. In this way, the reamer bit 6 may cut the coal seam to achieve the purpose of expanding the borehole.

It is recommended to retract the drill pipe 4 by 0.5 m per minute. The retract speed can be dynamically adjusted according to the amount of coal returned from the wellhead. After the drill pipe 4 retracts by 5 m (to be noted, this retraction distance can be adjusted according to actual situations), the retracting process may be stopped. Moreover, the pump pressure may be gradually reduced to a point where the main blade 26 can be closed. As the pump pressure decreases, the main blade 26 may close and retract inside the reamer bit 6 under an action of the fixed spring 28. At this stage, the drilling rig outside the borehole may be turned off. That is, a first section of the drilling and excavation task has been completed.

Figure 7:
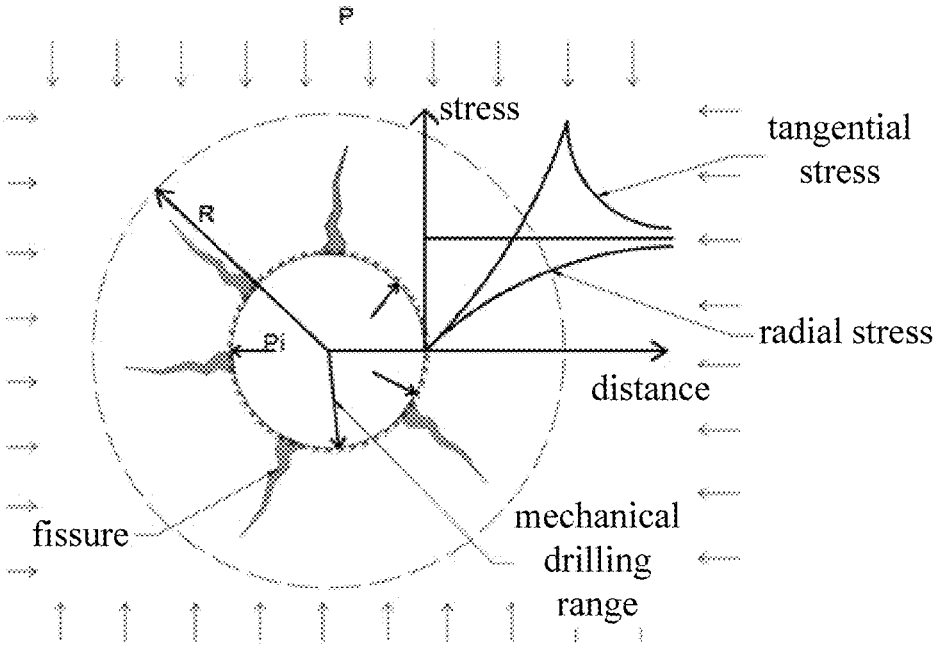
FIG. 7 is a schematic diagram of a distribution of plastic circles around an excavation space after the rotary cutting and hole expanding excavation operations according to examples of the present disclosure.

FIG. 7 is a schematic diagram of a distribution of plastic circles around an excavation space after the rotary cutting and hole expanding excavation operation according to examples of the present disclosure.

After the coal mining, the pressure of the rock mass above the small cavern space would be transferred to the surrounding coal body, which results in stress concentration. At the same time, an original three-dimensional principal stress state suffered by the surrounding coal body may change into a bi-directional or even a unidirectional stress. Moreover, the strength may correspondingly decrease, which may cause damages to the surrounding coal body. As a sharp decrease in stress occurs, the high concentrated stress may gradually transfer to a three-dimensional stress body deep in the coal body. The advanced support pressure generated by concentrated stress may be used to assist in fracturing the coal at a front end of the mining area. At the same time, a small plastic loosened circle may be generated around the small cavern space, and mechanical mining forms a small hole making space to form a three-dimensional cavity free surface for subsequent hydraulic mining to break coal, causing varying degrees of damages to the surrounding coal body, resulting in a small plastic loosened circle, which provides convenience for subsequent hydraulic mining, saves energy, and improves the efficiency.

In step S602, the step of transporting the coal-air-water mixture formed after the rotary cutting, drilling and slotting operations to the coal-air-water separation module through the air lift reverse circulation module may include: conveying high-pressure air to the annular gap between the inner wall and the outer wall of the dual-wall drill pipe 11 through the air compressor 9 in the air lift reverse circulation module; conveying the high-pressure air to the coal-air-water mixture in the inner pipe of the dual-wall drill pipe 11 through the air-liquid mixer 12 in the air lift reverse circulation module; and conveying the coal-air-water mixture through the single wall drill pipe 13 and the inner pipe of the dual-wall drill pipe 11 in the air lift reverse circulation module to the coal-air-water separation module through a reverse circulation.

In some examples of the present disclosure, after the completion of the first section of the expansion and cutting task, the drill pipe 4 and the reamer bit 6 would be withdrawn, and a single wall drill pipe 13 and a dual-wall drill pipe 11 with a reverse circulation roller bit 14 at the end may be lowered into the borehole. The air-liquid mixer 12 may be placed at the bottom of the dual-wall drill pipe 11. After the installation process, the air compressor 9 may be opened. Air may be mixed into the coal-air-water mixture through the air-liquid mixer 12 in the air lift reverse circulation module. The coal-air-water mixture may be transported along the inner pipe to the coal-air-water separator 7 in the coal-air-water separation module due to a pressure difference between the inner pipe of the dual-wall drill pipe 11 and the drilling hole. Then, the air compressor 9 may be turned off. At this point, the mechanical mining of the first section is completed.

In step S603, the jet coal breaking module may be used to perform jet coal breaking operations on the coal scam. The jet coal breaking operations may include: pressurizing the water and sand in the mixing truck 16 of the jet coal breaking module through the fracturing truck 15 of the jet coal breaking module; transporting the pressurized water and sand through a high-pressure hose 22 to the jet tool string 23 in the jet coal breaking module; performing an abrasive jet rotary cutting on the coal seam through the jet tool string 23 to perform a retractable coal mining.

In some examples of the present disclosure, performing an abrasive jet rotary cutting on the coal seam through the jet tool string 23 may include: making a circular cross-section formed by jet directions of a rotary cutting performed by the jet tool string 23 perpendicular to a roof and a floor of the coal seam; and mining the coal seam with the jet tool string 23. Noted that, it also works that the jet directions of the jetting tool string 23 not perpendicular to the top plate and the bottom plate of the coal seam. However, it would be more efficient when the jet directions are perpendicular to the top plate and the bottom plate of the coal scam.

In some examples of the present disclosure, after the completion of a mechanical mining of the first section, the dual-wall drill pipe 11 and the single wall drill pipe 13 may be withdrawn, and the drill pipe 4 and the jet tool string 23 may be lowered to perform a secondary coal breaking in the same section. The jet tool string 23 may be installed at the end of the drill pipe 4, and the jet directions of the jet tool string 23 may be perpendicular to the top plate and the bottom plate of the coal seam. The abrasive from the abrasive tank 17 and the water from the water tank 18 are transported to the mixing truck 16. Water and sand in the mixing truck 16 may be pressurized by the fracturing truck 15 and transported to the jet tool string 23 through the high-pressure hose 22. The water and sand may then be sprayed through a nozzle of the jet tool string 23 to form a high-pressure water jet. At the same time, the drill pipe rotation device 3 may drive the drill pipe 4 to rotate, which may cause the high-pressure water jet to break coal again in the same section within a circular range. While rotating, the jet tool string 23 may retract at a constant speed of 0.5 m per minute until the working face of the coal seam section is completely mined by the jet tool string 23. Finally, the drill pipe 4 and the jet tool string may be pulled out.

Jet coal breaking operations can achieve secondary borehole expansion after mechanical coal breaking, compensating for the incomplete extraction of extra thick coal seams due to the influence of the maximum coal breaking radius caused by mechanical borehole equipment. Through jet coal breaking operations, the cutting range of coal may be increased to the top plate and the bottom plate of the coal seam, and a secondary crushing of the broken coal body formed by mechanical coal breaking can be achieved. It should be noted that the aforementioned uniform retract speed of 0.5 meters per minute is only an example. In other examples of the present disclosure, other retract speeds can be adopted, which can be adjusted accordingly based on the actual coal quantity and other on-site conditions.

Furthermore, in step S604, after mining the coal seam using the jet tool string 23, the dual-wall drill pipe 11 may be lowered into the borehole again, which is used to lift the coal-air-water mixture through the inner pipe of the dual-wall drill pipe 11 to the coal-air-water separator 7 using a reverse circulation. At this point, the coal seam of the working face in this section has been fully mined. That is, a mining process is completed. Then, the dual-wall drill pipe 11 would be withdrawn. The reamer bit 6 and the drill pipe 4 may be inserted into the borehole and positioned in a second section of the coal seam. A small-scale mechanical coal breaking of the second section may be carried out by repeating the above steps to complete coal mining of the second section. Then, a coal mining of a third section would be carried out, and so on, until the coal seam in that area is fully mined.

In step S605, during the coal mining process, crushed coal powders and water are fully mixed, and the coalbed methane is located at an upper part of the mixture. The mixture would be transported together to the coal-air-water separator 7 through the inner pipe of the dual-wall drill pipe 11. After a separation of the mixture, the remaining mixture may be transported to the sedimentation tank 8. Coal slag may be sedimented at the bottom of the sedimentation tank 8, and waste water at the top of the sedimentation tank 8 may be filtered out. Through a pump, the water in sedimentation tank 8 can be discharged through pipelines to the wellhead. That is, the water from the coal-air-water mixture can be recycled. The aforementioned coalbed methane may be low concentration coalbed methane.

From the above description, it can be seen that by the coal mining method provided by example of the present disclosure coal mining of coal seams without human working in boreholes can be achieved. In this way, risks caused by coal and gas outbursts, rock burst, or water inrush during mining can be effectively reduced. Since only a few people are needed to operate drilling rigs on the ground, the working environment is greatly improved. Accordingly, labor costs are effectively reduced too.

In addition, all ground supporting facilities in examples of the present disclosure are movable, therefore, the coal mining system and the coal mining method disclosed by examples of the present disclosure are very suitable for mining corner coal with uneven distribution or limited coal resources.

Moreover, in the coal breaking process of the coal mining method, a mechanical mining process of small-scale boreholes is first performed. Then, large-scale coal mining may be performed by abrasive jet. It can be seen that the coal mining method can be well applied to the mining of ultra-thick coal seams, medium hard to hard coal seams. Furthermore, the technical solution can also be well adapted to the three soft coal seams, "three down" pressure coal seams, and coal and gas outburst coal seams.

In addition, because the coal mining method of the present disclosure adopts a water jet technique to break coal, open fires can be effectively avoided, combustions and gas explosions can also be prevented. Moreover, coal may be washed underground by the flushing of the well water efficiently.

In summary, the coal mining system and the coal mining method of the present disclosure is safe, green, and efficient, with good adaptability and low cost.

It should be noted that the method according to examples of the present disclosure may be performed by a single device, such as a computer or server. Moreover, the method according to examples of the present disclosure can also be applied to a distributed scenario, where the method can be implemented through cooperation of multiple devices. In the case of such a distributed scenario, one device of the plurality of devices may only perform one or more steps of the method, and the plurality of devices may interact with each other to perform the described method.

It is noted that some examples of the present disclosure have been described above. Other examples are within the scope of the following claims. In some cases, the acts or steps recited in the claims may be performed in a different order than in the examples described above and can still achieve desirable results. Additionally, the processes depicted in the accompanying drawings do not necessarily require the particular order shown, or sequential order, to achieve desirable results. In some examples, multi-tasking and parallel processing are also possible or may be advantageous.

Those of ordinary skill in the art should appreciate that the discussion on any one of the foregoing examples is merely exemplary, but is not intended to imply that the scope of the present disclosure (including the claims) is limited to these examples. Under the idea of the present disclosure, the technical features of the foregoing examples or different examples may be combined, the steps may be implemented in any order, and there are many other variations in different aspects of the examples of the present disclosure, all of which are not provided in detail for simplicity.

Besides, for the sake of simplifying description and discussion and not making the examples of the present disclosure difficult to understand, the provided drawings may show or not show the public power supply/earthing connection to an integrated circuit (IC) chip and other parts. Besides, the device may be shown in block diagram form to prevent the examples of the present disclosure from being difficult, and moreover, this considers the following facts, that is, the details of the implementations with regard to the devices in these block diagrams highly depend on the platform which will implement the examples of the present disclosure (that is, these details should be completely within the scope understood by those skilled in the art). Where specific details (e.g. circuits) are set forth in order to describe exemplary examples of the present disclosure, it should be apparent to those skilled in the art that the examples of the present disclosure can be practiced without, or with variation of, these specific details. Therefore, these descriptions shall be considered to be illustrative instead of restrictive thereto. Therefore, these descriptions shall be considered to be illustrative instead of restrictive thereto.

While the present disclosure has been described in conjunction with specific examples thereof, many alternatives, modifications and variations of such examples will be apparent to those of ordinary skill in the art in light of the foregoing description. For example, other memory architectures, such as dynamic RAM (DRAM), may use the examples discussed.

The examples of the disclosure are intended to embrace all such alternatives, modifications, and variations as to fall within the broad scope of the appended claims. Therefore, any omission, modification, equivalent replacement and improvement made within the spirits and principles of the examples of the present disclosure shall fall within the protection scope of the present disclosure.

What is claimed is:

1. A mining method, applied to a mining system, wherein, the mining system comprises: a mechanical coal breaking module, an air lift reverse circulation module, a jet coal breaking module, and a coal-air-water separation module; wherein, the mechanical coal breaking module comprises: a drill pipe rotating device, a drill pipe, and a reamer bit; the drill pipe rotating device, the drill pipe and the reamer bit are connected sequentially to perform rotary cutting, drilling and slotting operations on a coal seam in a borehole; wherein, the reamer bit comprises a drill bit pin, a main blade, a blade support rod, a high-pressure water channel, a central shaft rod, a support; and the reamer bit is connected to the drill pipe through the drill bit pin;

the air lift reverse circulation module comprises: an air compressor and a dual-wall drill pipe; the air compressor is configured to transport a coal-air-water mixture through an inner pipeline of the dual-wall drill pipe to the coal-air-water separation module; and the jet coal breaking module comprises: the drill pipe rotating device, a fracturing truck, the drill pipe, and a jet tool string; the fracturing truck, the drill pipe rotating device, the drill pipe, and the jet tool string are connected sequentially to mine the coal seam; wherein, the coal mining method comprises:

performing the rotary cutting, drilling and slotting operations on the coal seam in the borehole through the mechanical coal breaking module; wherein, performing the rotary cutting, drilling and slotting operations on the coal seam in the borehole through the mechanical coal breaking module comprises: installing the reamer bit onto the drill pipe through the drill bit pin; ensuring the main blade of the reamer bit in a closed state; driving the reamer bit to a target position of a coal seam by a motor in the borehole; turning on a drilling rig outside the borehole to drive the drill pipe to rotate at a low speed; pushing the support to move downwards along the central shaft rod by high-pressure water flowing through the high-pressure water channel into a cavity; pushing the blade support rod to move synchronously downwards by the support, so that the force of the high-pressure water may open the main blade slowly with the drill pipe; opening the main blade as a drilling volume continues to increase; rotating the reamer bit with the drill pipe to cut the coal seam to expand the borehole;

transporting the coal-air-water mixture formed after the rotary cutting, drilling and slotting operations to the coal-air-water separation module through the air lift reverse circulation module;

performing coal breaking operations on the coal seam through the jet coal breaking module;

transporting the coal-air-water mixture formed after the coal breaking operations to the coal-air-water separation module through the air lift reverse circulation module; and separating the coal-air-water mixture to obtain coal, coal-bed methane and water through the coal-air-water separation module.

2. The mining method according to claim 1, wherein, transporting the coal-air-water mixture formed after the rotary cutting, drilling and slotting operations to the coal-air-water separation module through the air lift reverse circulation module comprises:

delivering high-pressure air to an annular gap between an inner wall and an outer wall of the dual-wall drill pipe through the air compressor in the air lift reverse circulation module;

delivering the high-pressure air to the coal-air-water mixture in the inner pipe of the dual-wall drill pipe through an air-liquid mixer in the air lift reverse circulation module; and transporting the coal-air-water mixture to the coal-air-water separation module through a single wall drill pipe in the air lift reverse circulation module and the inner pipe of the dual-wall drill pipe in the air lift reverse circulation module by a reverse circulation.

3. The mining method according to claim 1, wherein, performing coal breaking operations on the coal seam through the jet coal breaking module comprises:

pressurizing water and sand in a mixing truck in the jet coal breaking module through the fracturing truck in the jet coal breaking module;

transporting the water and sand pressurized through a high-pressure hose to the jet tool string in the jet coal breaking module; and performing an abrasive jet rotary cutting on the coal seam through the jet tool string to implement a retractable coal mining.

4. The mining method according to claim 3, wherein, performing an abrasive jet rotary cutting on the coal seam through the jet tool string comprises:

making a circular cross-section formed by jet directions of a rotary cutting performed by the jet tool string perpendicular to a roof and a floor of the coal seam; and mining the coal seam with the jet tool string.

* * * * *